US010268155B2

(12) United States Patent
Otomura et al.

(10) Patent No.: US 10,268,155 B2
(45) Date of Patent: Apr. 23, 2019

(54) WASTE TONER TRANSPORT UNIT AND IMAGE FORMING APPARATUS

(71) Applicant: Sharp Kabushiki Kaisha, Osaka (JP)

(72) Inventors: Norimichi Otomura, Osaka (JP); Tohru Nishikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/616,035

(22) Filed: Jun. 7, 2017

(65) Prior Publication Data

US 2017/0364024 A1 Dec. 21, 2017

(30) Foreign Application Priority Data

Jun. 21, 2016 (JP) ..... 2016-122431

(51) Int. Cl.
*G03G 21/12* (2006.01)
*G03G 21/10* (2006.01)
*G03G 21/00* (2006.01)

(52) U.S. Cl.
CPC ..... *G03G 21/12* (2013.01); *G03G 21/105* (2013.01); *G03G 21/0017* (2013.01); *G03G 21/0029* (2013.01); *G03G 2221/0005* (2013.01)

(58) Field of Classification Search
CPC .. G03G 21/12; G03G 21/105; G03G 21/0017; G03G 21/0029; G03G 2221/0005
See application file for complete search history.

(56) References Cited

U.S. PATENT DOCUMENTS 6,963,713 B2 * 11/2005 Isomura ..... G03G 9/0821 222/DIG. 1
8,346,151 B2 * 1/2013 Akaike ..... G03G 21/105 399/101
2010/0232852 A1 * 9/2010 Noso ..... G03G 21/105 399/358
2011/0097124 A1 * 4/2011 Koike ..... G03G 21/12 399/358
2011/0255907 A1 * 10/2011 Mihara ..... G03G 15/0875 399/263

FOREIGN PATENT DOCUMENTS

JP 2010-277009 A 12/2010

* cited by examiner

*Primary Examiner* — Gregory H Curran
(74) *Attorney, Agent, or Firm* — Renner Otto Boisselle & Sklar, LLP

(57) ABSTRACT

A waste toner transport unit includes a waste toner transport path through which waste toner removed from a circumferential surface of an image carrier is transported, a transport member that transports the waste toner along the waste toner transport path, and a movement restrictor that restricts the movement of the waste toner in a process of waste toner transportation. The waste toner transport path includes an area in which an inner bottom surface is inclined and the area constitutes the movement restrictor. The transport member is disposed such that a rotation shaft extends along the inclined inner bottom surface.

7 Claims, 14 Drawing Sheets

WASTE TONER TRANSPORT UNIT AND IMAGE FORMING APPARATUS

BACKGROUND

1. Field

The present disclosure relates to a waste toner transport unit that transports waste toner and an image forming apparatus including the waste toner transport unit.

2. Description of the Related Art

In an image forming apparatus, toner left on an image carrier is scratched off by a cleaning blade and transported to a waste toner container while being agitated by a waste toner transport unit. As illustrated in FIG. 14A, the waste toner transport unit usually includes a waste toner transport path, through which waste toner is transported, and a transport screw, which transports the waste toner along the waste toner transport path (see, for example, Japanese Unexamined Patent Application Publication No. 2010-277009).

In an existing waste toner transport unit, the transport screw and the waste toner transport path are arranged parallel to the rotation shaft of the image carrier. Thus, as illustrated in FIG. 14B, the transport screw and the waste toner transport path are arranged horizontally. Waste toner is thus transported horizontally along the inner bottom surface of the waste toner transport path.

However, waste toner is less likely to be compacted by only being transported horizontally. In an existing waste toner transport unit, waste toner having low bulk density is thus transported to the waste toner container. When waste toner having low bulk density is collected in the waste toner container, the waste toner container is filled with waste toner soon.

If, for example, a user shakes a waste toner container to compact waste toner, the waste toner has higher bulk density and a space capable of receiving more waste toner can be created in the waste toner container, so that collection of waste toner can be continued. Such an operation, however, is required every time after the waste toner container is filled up and is thus troublesome for a user.

SUMMARY

An aspect of the disclosure is a waste toner transport unit capable of discharging waste toner having high bulk density and another aspect of the disclosure is an image forming apparatus including the waste toner transport unit.

A waste toner transport unit according to an aspect of the disclosure includes a waste toner transport path, a transport member, and a movement restrictor. Through the waste toner transport path, waste toner removed from the circumferential surface of an image carrier is transported. The transport member transports waste toner along the waste toner transport path. The movement restrictor restricts the movement of waste toner in a process of waste toner transportation.

An image forming apparatus according to an aspect of the disclosure includes an image carrier, a cleaning unit, and the waste toner transport unit. The cleaning unit removes toner left on the circumferential surface of an image carrier as waste toner. The waste toner transport unit transports waste toner removed by the cleaning unit.

BRIEF DESCRIPTION OF THE DRAWINGS

FIG. 14A is a front sectional view of the waste toner transport unit and FIG. 14B is a cutaway view of the waste toner transport unit.

DESCRIPTION OF THE EMBODIMENTS

Hereinbelow, embodiments where waste toner transport units according to some aspects of the disclosure are applied to an image forming apparatus are described in detail.

Figure 1:
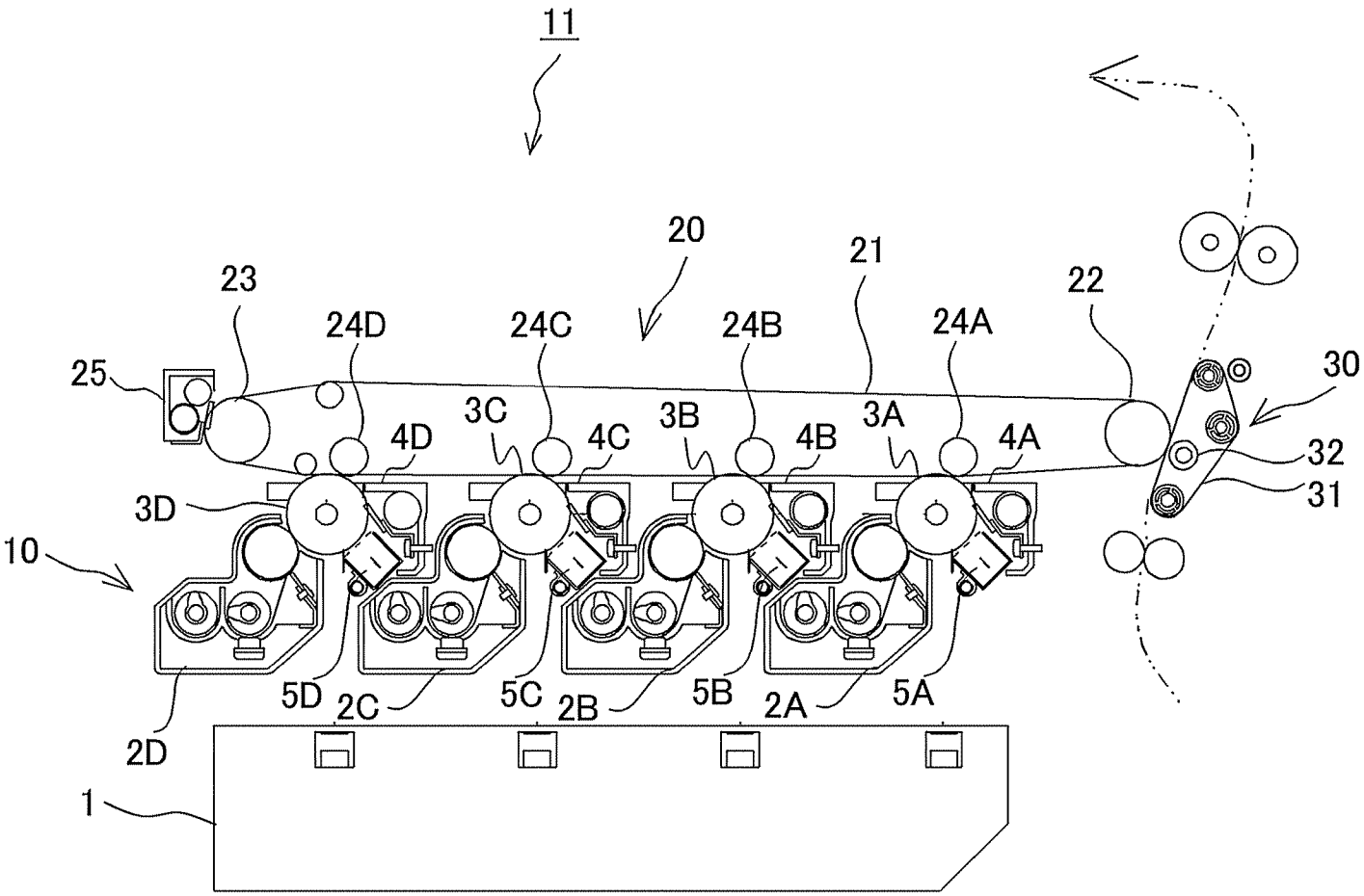
FIG. 1 is a schematic diagram of a related portion of an image forming apparatus including a waste toner transport unit according to an embodiment of the disclosure.

An image forming apparatus 11 performs multicolor and single-color printing on sheets depending on image data. As illustrated in FIG. 1, the image forming apparatus 11 includes, at its related portion, an image forming unit 10, an intermediate transfer unit 20, and a second transfer unit 30.

The image forming unit 10 includes an exposure unit 1, developing devices 2A to 2D, photoconductor drums 3A to 3D, cleaning units 4A to 4D, and charging devices 5A to 5D. The image forming unit 10 performs printing on sheets. The photoconductor drums 3A to 3D correspond to image carriers according to an aspect of the disclosure.

The developing devices 2A to 2D, the photoconductor drums 3A to 3D, the cleaning units 4A to 4D, and the charging devices 5A to 5D are respectively arranged in four image stations corresponding to images of colors of black (K), cyan (C), magenta (M), and yellow (Y). The stations form four types of latent images corresponding to the respective colors. Each of the cleaning units 4A to 4D scrapes and collects, using a cleaning blade, waste toner left on the circumferential surface of the corresponding one of the photoconductor drums 3A to 3D after a first transfer.

The charging devices 5A to 5D uniformly charge the surfaces of the photoconductor drums 3A to 3D at a predetermined potential. The exposure unit 1 is a laser scanning unit (LSU) including laser emitters and reflecting mirrors. The exposure unit 1 exposes the charged circumferential surfaces of the photoconductor drums 3A to 3D with light to form electrostatic latent images based on image data on the circumferential surfaces of the photoconductor drums 3A to 3D. The developing devices 2A to 2D render the electrostatic latent images formed on the circumferential surfaces of the photoconductor drums 3A to 3D visible using toner of four colors (Y, M, C, and K).

The intermediate transfer unit 20 includes an intermediate transfer belt 21, a driving roller 22, a driven roller 23, first transfer rollers 24A to 24D, and a cleaner 25. The intermediate transfer belt 21 is wound around the driving roller 22 and the driven roller 23 and moves along a circulative route passing by the photoconductor drums 3D, 3C, 3B, and 3A in this order. The first transfer rollers 24A to 24D first-transfer the toner images formed on the circumferential surfaces of the photoconductor drums 3A to 3D to the surface of the intermediate transfer belt 21.

The second transfer unit 30 includes a second transfer belt 31 and a second transfer roller 32. The second transfer belt 31 is wound around multiple rollers and moves along a predetermined circulative route. The second transfer roller 32 is disposed so as to face the driving roller 22 with the intermediate transfer belt 21 and the second transfer belt 31 interposed therebetween. The second transfer unit 30 second-transfers a toner image on the surface of the intermediate transfer belt 21 to a sheet that has been transported to a second transfer position between the intermediate transfer belt 21 and the second transfer belt 31. The cleaner 25 collects toner left on the surface of the intermediate transfer belt 21.

Now, waste toner transport units according to some embodiments of the disclosure are described in detail. Each waste toner transport unit is disposed in the cleaning units 4A to 4D.

First Embodiment

Figure 2:
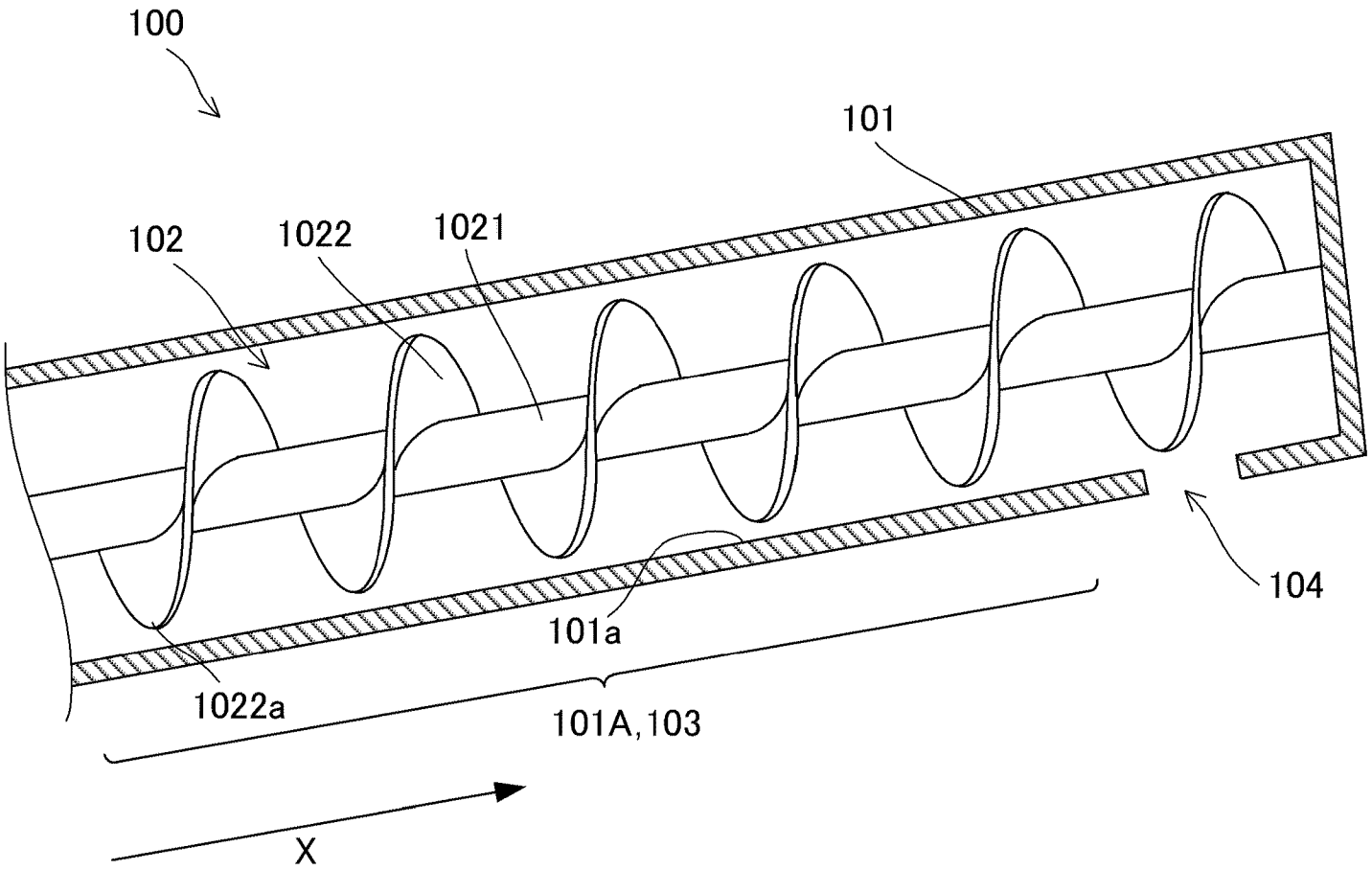
FIG. 2 is a schematic cutaway view of a related portion of a waste toner transport unit according to a first embodiment.
Figure 14B:
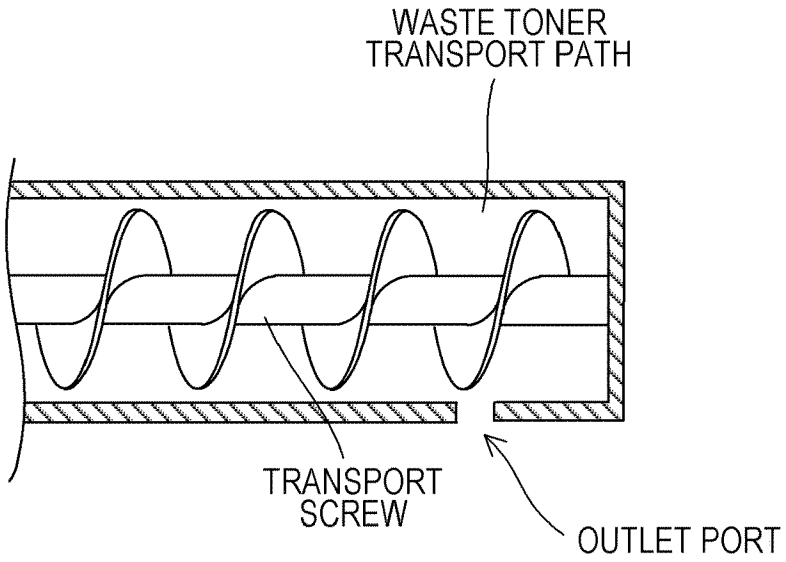
FIGS. 14A and 14B illustrate an existing waste toner transport unit, where
Figure 14A:
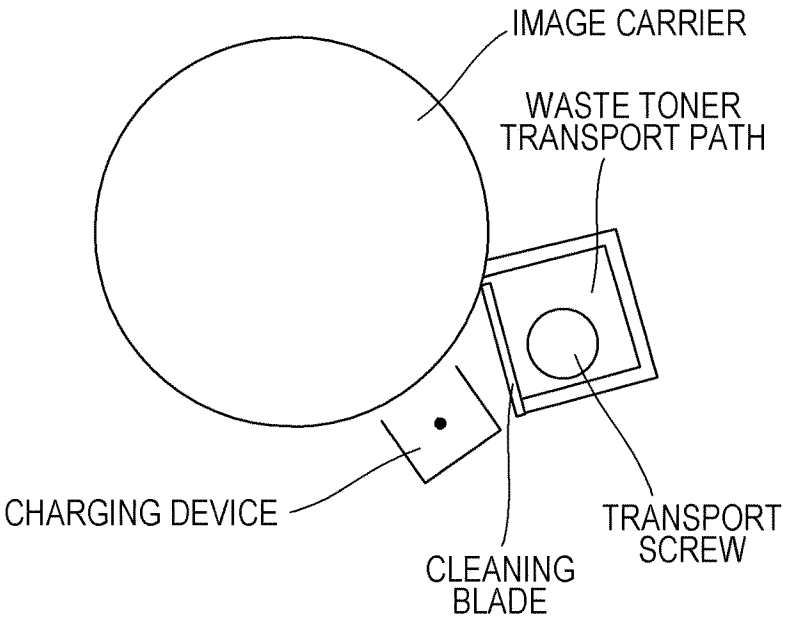

As illustrated in FIG. 2, a waste toner transport unit 100 according to a first embodiment of the disclosure includes a waste toner transport path 101, a transport screw 102, and a movement restrictor 103. The waste toner transport path 101 is disposed so as to at least partially face a photoconductor drum and a cleaning blade (refer to FIGS. 1, 14A, and 14B). The transport screw 102 corresponds to a transport member according to an aspect of the disclosure.

The waste toner transport path 101 allows waste toner removed by the cleaning blade from the circumferential surface of the photoconductor drum to be transported therethrough. Although not illustrated in FIG. 2, the waste toner transport path 101 includes a receiving portion, which is open at the position facing the photoconductor drum, to receive waste toner therethrough.

The waste toner transport path 101 has an inner bottom surface 101*a* having an outlet port 104, from which waste toner is discharged, at a downstream portion in a transport direction X (indicated with an arrow in FIG. 2). Waste toner is discharged from the outlet port 104 and collected in a waste toner container, not illustrated. Here, the expression of "the inner bottom surface" means "an inner surface located on the lower side" in the vertical direction when the waste toner transport unit 100 is installed in the image forming apparatus 11 in a normal position. This similarly applies to the following description.

As illustrated in FIG. 2, the waste toner transport path 101 includes an area 101A, in which the inner bottom surface 101*a* is inclined. In this embodiment, the inner bottom surface 101*a* is inclined in the area 101A upward from the upstream side to the downstream side in the transport direction X.

The transport screw 102 transports waste toner along the waste toner transport path 101. As illustrated in FIG. 2, the transport screw 102 includes a rotation shaft 1021 and a helical blade member 1022 disposed on the circumferential surface of the rotation shaft 1021. The transport screw 102 is disposed in the waste toner transport path 101 such that an edge portion 1022*a* of the blade member 1022 disposed along the inner bottom surface 101*a* of the waste toner transport path 101 comes into contact with or is adjacent to the inner bottom surface 101*a*. In other words, the transport screw 102 is disposed such that the rotation shaft 1021 extends along the inclined inner bottom surface 101*a*. When the transport screw 102 rotates, waste toner moves in the transport direction X while being agitated by the blade member 1022 and is transported to the outlet port 104.

In this embodiment, the inclined area 101A of the inner bottom surface 101*a* of the waste toner transport path 101 functions as the movement restrictor 103. Specifically, the waste toner passing by the movement restrictor 103 receives the force in the direction opposite to the transport direction X due to the effect of the gravity. In this manner, waste toner mainly receives an influence of the gravity at the movement restrictor 103. In the process of waste toner transportation, the movement restrictor 103 thus restricts the movement of waste toner. Meanwhile, waste toner is sequentially transported from the upstream side in the transport direction X. The waste toner whose movement is restricted is pressed by the waste toner transported from the upstream side and is thus gradually compressed and compacted. Waste toner thus increases its bulk density.

When the waste toner is discharged from the waste toner transport unit 100 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

Second Embodiment

Figure 3:
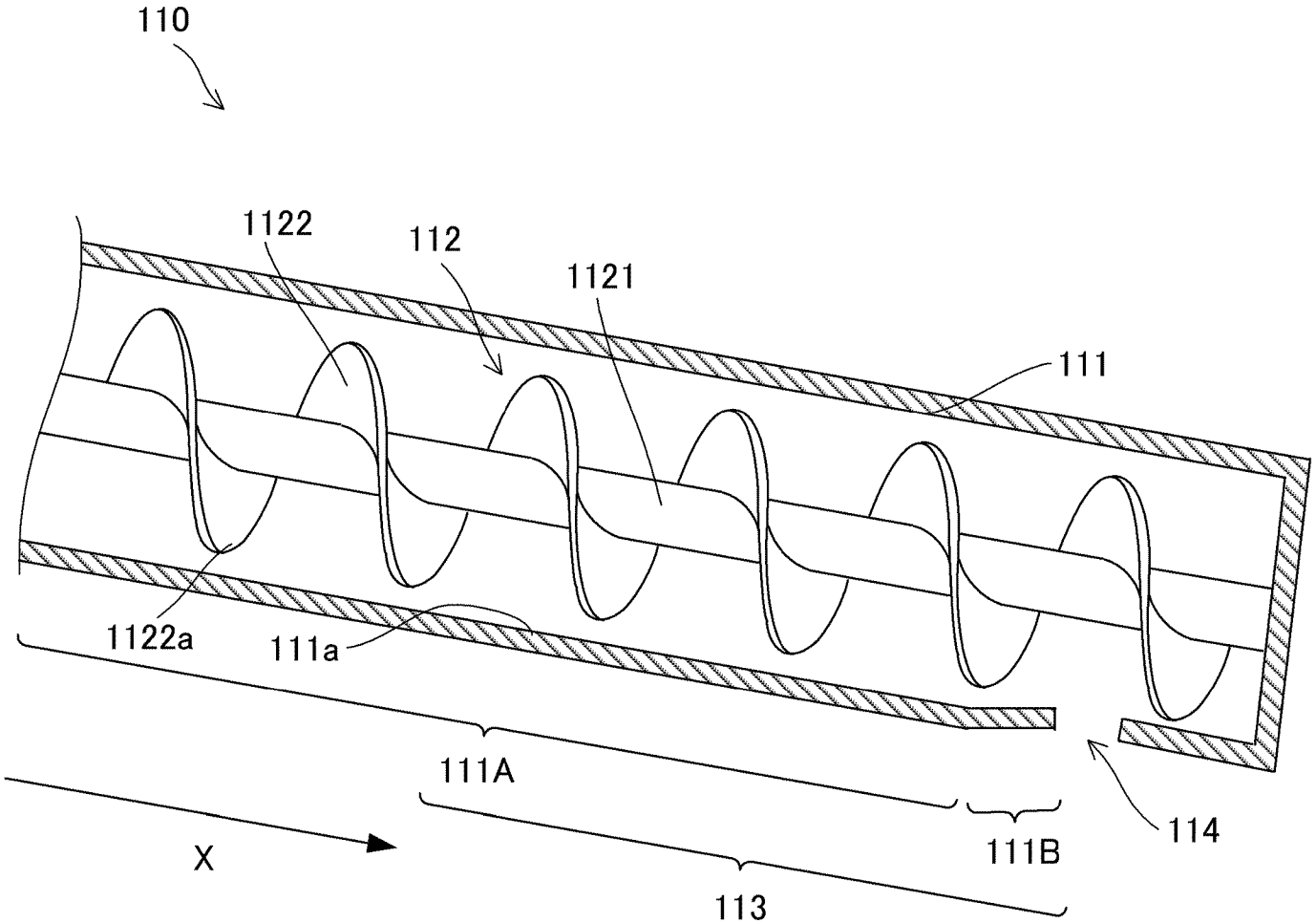
FIG. 3 is a schematic cutaway view of a related portion of a waste toner transport unit according to a second embodiment.

As illustrated in FIG. 3, a waste toner transport unit 110 according to a second embodiment of the disclosure includes a waste toner transport path 111, a transport screw 112, and a movement restrictor 113. Similarly to the waste toner transport path 101 of the waste toner transport unit 100, the waste toner transport path 111 is disposed so as to at least partially face the photoconductor drum and the cleaning blade (refer to FIGS. 1, 14A, and 14B). The transport screw 112 corresponds to a transport member according to an aspect of the disclosure. Similarly to the waste toner transport path 101 of the waste toner transport unit 100, the waste toner transport path 111 allows waste toner to be transported therethrough.

The waste toner transport path 111 has an inner bottom surface 111*a* having an outlet port 114, from which waste toner is discharged, at a downstream portion in the transport direction X (indicated with an arrow in FIG. 3). Waste toner is discharged from the outlet port 114 and collected in a waste toner container, not illustrated.

As illustrated in FIG. 3, the waste toner transport path 111 has an area 111A, in which the inner bottom surface 111*a* is inclined. In this embodiment, in the area 111A, the inner bottom surface 111*a* is inclined downward from the upstream side to the downstream side in the transport direction X. The inner bottom surface 111*a* of the waste toner transport path 111 also has a horizontal area 111B continuous with a downstream portion of the area 111A.

The transport screw 112 transports waste toner along the waste toner transport path 111. As illustrated in FIG. 3, similarly to the transport screw 102 of the waste toner transport unit 100, the transport screw 112 includes a rotation shaft 1121 and a helical blade member 1122, which has an edge portion 1122*a*. Specifically, the transport screw 112 is disposed such that the rotation shaft 1121 extends along the inclined inner bottom surface 111*a*. When the transport screw 112 rotates, waste toner moves in the transport direction X while being agitated by the blade member 1122 and is transported to the outlet port 114.

In this embodiment, the inclined area 111A and the horizontal area 111B continuous with the downstream portion of the area 111A of the inner bottom surface 111*a* of the waste toner transport path 111 function as the movement restrictor 113. Specifically, the waste toner passing by the movement restrictor 113 firstly receives, in the area 111A, the force in the direction the same as the transport direction X due to the effect of the gravity and thus moves smoothly over the area 111A. Here, the waste toner is neither compressed nor compacted. Subsequently, when the waste toner moves to the horizontal area 111B, waste toner collectively transfers from the area 111A to the area 111B and accumulates in the area 111B. The waste toner in the area 111B is thus pressed by waste toner sequentially transported from the area 111A and is thus gradually compressed and compacted. The waste toner thus increases its bulk density.

When the waste toner is discharged from the waste toner transport unit 110 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

Third Embodiment

Figure 4:
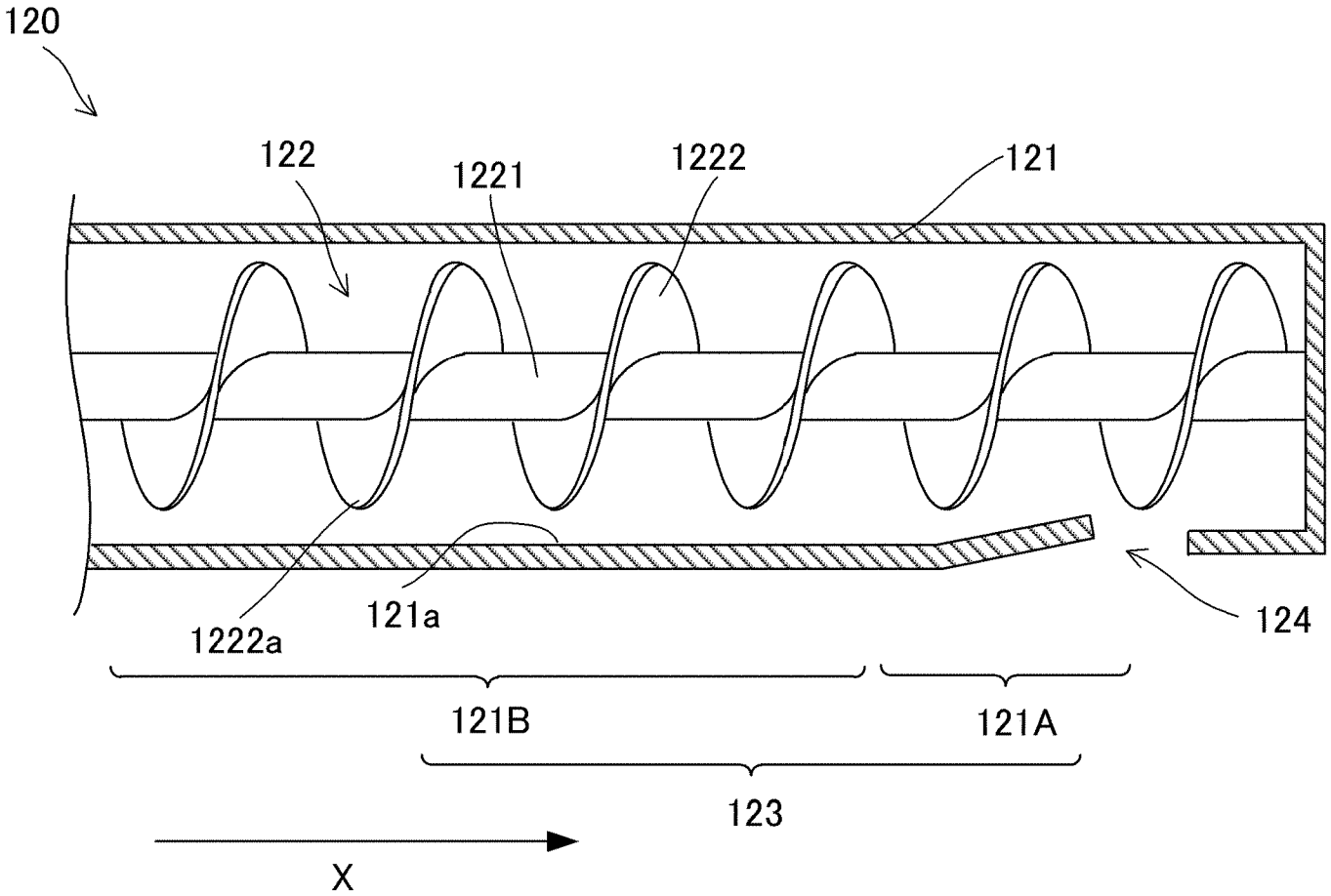
FIG. 4 is a schematic cutaway view of a related portion of a waste toner transport unit according to a third embodiment.

As illustrated in FIG. 4, a waste toner transport unit 120 according to a third embodiment of the disclosure includes a waste toner transport path 121, a transport screw 122, and a movement restrictor 123. Similarly to the waste toner transport path 101 of the waste toner transport unit 100, the waste toner transport path 121 is disposed so as to at least partially face the photoconductor drum and the cleaning blade (refer to FIGS. 1, 14A, and 14B). The transport screw 122 corresponds to a transport member according to an aspect of the disclosure. Similarly to the waste toner transport path 101 of the waste toner transport unit 100, the waste toner transport path 121 allows waste toner to be transported therethrough.

The waste toner transport path 121 has an inner bottom surface 121*a* having an outlet port 124, from which waste toner is discharged, at a downstream portion in the transport direction X (indicated with an arrow in FIG. 4). Waste toner is discharged from the outlet port 124 and collected in a waste toner container, not illustrated.

As illustrated in FIG. 4, the waste toner transport path 121 has an area 121A, in which the inner bottom surface 121*a* is inclined, at a downstream portion. In this embodiment, in the area 121A, the inner bottom surface 121*a* is inclined upward from the upstream side to the downstream side in the transport direction X. The waste toner transport path 121 has an area 121B, in which the inner bottom surface 121*a* is horizontal, at an upstream portion. The area 121A and the area 121B are arranged so as to be continuous from the downstream portion of the area 121B to the upstream portion of the area 121A.

The transport screw 122 transports waste toner along the waste toner transport path 121. As illustrated in FIG. 4, similarly to the transport screw 102 of the waste toner transport unit 100, the transport screw 122 includes a rotation shaft 1221 and a helical blade member 1222, which has an edge portion 1222*a*. The transport screw 122 is disposed such that the rotation shaft 1221 extends along the inner bottom surface 121*a* having a horizontal area 121B. When the transport screw 122 rotates, waste toner moves in the transport direction X while being agitated by the blade member 1222 and is transported to the outlet port 124.

In this embodiment, the area 121A and the area 121B of the inner bottom surface 121*a* of the waste toner transport path 121 function as the movement restrictor 123. Specifically, waste toner passing by the movement restrictor 123 smoothly moves over the area 121B in the transport direction X. When the waste toner transfers from the area 121B to the area 121A, on the other hand, the waste toner receives the force in the direction opposite to the transport direction X due to the effect of the gravity, so that a portion of the waste toner is interrupted at a boundary between the area 121B and the area 121A. Thus, in the process of waste toner transportation, the movement restrictor 123 restricts the movement of the waste toner. Meanwhile, waste toner is sequentially transported from the upstream side in the waste toner transport direction X. Thus, the waste toner whose movement is restricted is pressed by the waste toner transported from the upstream side and is thus gradually compressed and compacted. The waste toner thus increases its bulk density.

When the waste toner is discharged from the waste toner transport unit 120 and collected in the waste toner container, the waste toner accumulates in the waste toner container without leaving a space. Thus, the amount of waste toner collected in the waste toner container increases compared to the case where waste toner is collected by an existing waste toner transport unit.

Fourth Embodiment

Figure 5:
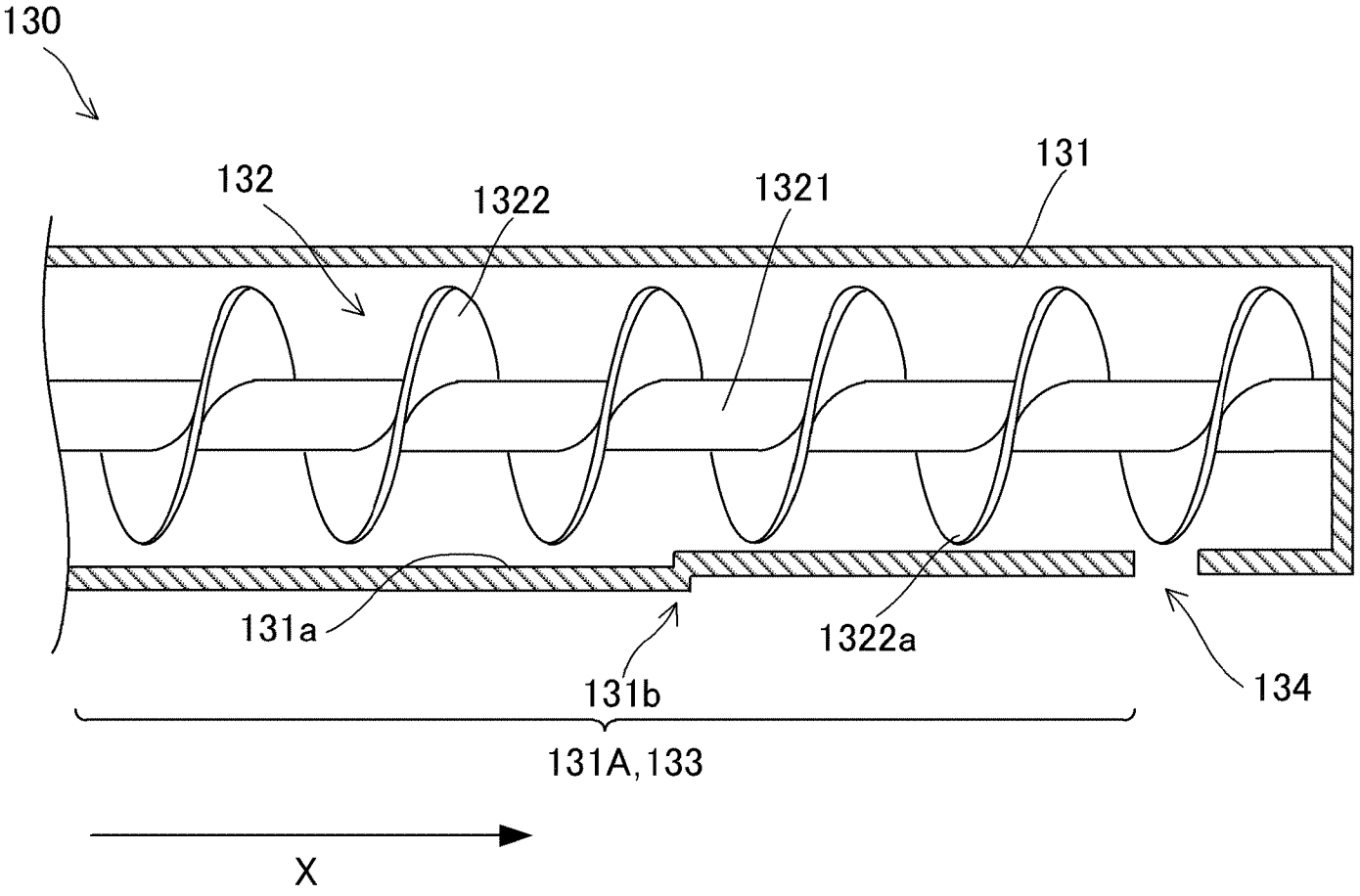
FIG. 5 is a schematic cutaway view of a related portion of a waste toner transport unit according to a fourth embodiment.

As illustrated in FIG. 5, a waste toner transport unit 130 according to a fourth embodiment of the disclosure includes a waste toner transport path 131, a transport screw 132, and a movement restrictor 133. Similarly to the waste toner transport path 101 of the waste toner transport unit 100, the waste toner transport path 131 is disposed so as to at least partially face the photoconductor drum and the cleaning blade (refer to FIGS. 1, 14A, and 14B). The transport screw 132 corresponds to a transport member according to an aspect of the disclosure. Similarly to the waste toner transport path 101 of the waste toner transport unit 100, the waste toner transport path 131 allows waste toner to be transported therethrough.

The waste toner transport path 131 has an inner bottom surface 131*a* having an outlet port 134, from which waste toner is discharged, at a downstream portion in the transport direction X (indicated with an arrow in FIG. 5). Waste toner is discharged from the outlet port 134 and collected in a waste toner container, not illustrated. The waste toner transport path 131 extends horizontally from the upstream side to the downstream side in the transport direction X.

As illustrated in FIG. 5, the waste toner transport path 131 has an area 131A in which a stepped portion 131*b* is disposed. In this embodiment, in the area 131A, the inner bottom surface 131*a* rises at the stepped portion 131*b*, used as a boundary, from the upstream side to the downstream side in the transport direction X.

The transport screw 132 transports waste toner along the waste toner transport path 131. As illustrated in FIG. 5, similarly to the transport screw 102 of the waste toner transport unit 100, the transport screw 132 includes a rotation shaft 1321 and a blade member 1322, which has an edge portion 1322*a*. Specifically, the transport screw 132 is disposed such that the rotation shaft 1321 extends along the inner bottom surface 131*a*. When the transport screw 132 rotates, waste toner moves in the transport direction X while being agitated by the blade member 1322 and is transported to the outlet port 134.

In this embodiment, the area 131A of the inner bottom surface 131*a* of the waste toner transport path 131 in which the stepped portion 131*b* is disposed functions as the movement restrictor 133. Specifically, waste toner passing by the movement restrictor 133 is interrupted at the stepped portion 131*b*. In the process of waste toner transportation, the movement restrictor 133 restricts the movement of the waste toner. Meanwhile, waste toner is sequentially transported from the upstream side in the waste toner transport direction X. The waste toner whose movement is restricted is thus pressed by the waste toner transported from the upstream side and is thus gradually compressed and compacted. Waste toner thus increases its bulk density.

When the waste toner is discharged from the waste toner transport unit 130 and collected in the waste toner container, the waste toner accumulates in the waste toner container without leaving a space. Thus, the amount of waste toner collected in the waste toner container increases compared to the case where waste toner is collected by an existing waste toner transport unit.

Fifth Embodiment

Figure 6:
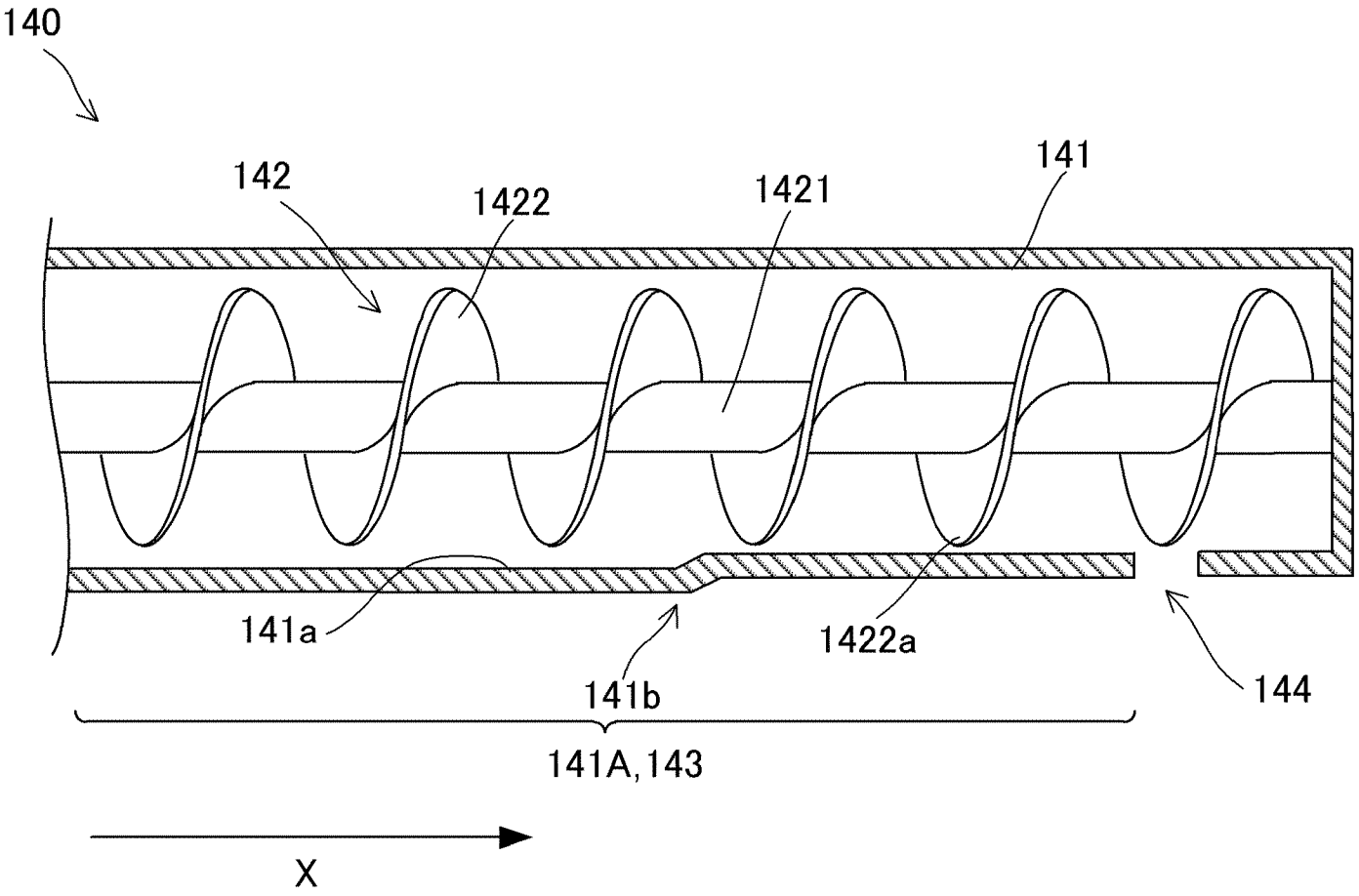
FIG. 6 is a schematic cutaway view of a related portion of a waste toner transport unit according to a fifth embodiment.

As illustrated in FIG. 6, a waste toner transport unit 140 according to a fifth embodiment of the disclosure includes a waste toner transport path 141, a transport screw 142, and a movement restrictor 143. The waste toner transport unit 140 has a configuration in which the stepped portion 131*b*, having an L-shaped cross section, of the waste toner transport unit 130 according to the fourth embodiment is replaced with an inclined portion. As illustrated in FIG. 6, the portion corresponding to the stepped portion 131*b* is inclined. This portion is referred to as an inclined portion 141*b*.

As described above, the waste toner transport unit 140 has the same configuration as the waste toner transport unit 130 except for the inclined portion 141*b*. Specifically, the transport screw 142 transports waste toner along the waste toner transport path 141. The waste toner transport path 141 has an inner bottom surface 141*a* having an outlet port 144, from which waste toner is discharged, at a downstream portion in a transport direction X (indicated with an arrow in FIG. 6). The transport screw 142 includes a rotation shaft 1421 and a blade member 1422, which has an edge portion 1422*a*.

Also in this embodiment, as in the case of the waste toner transport unit 130, an area 141A of the inner bottom surface 141*a* of the waste toner transport path 141 in which the inclined portion 141*b* is disposed functions as the movement restrictor 143. Specifically, waste toner passing by the movement restrictor 143 is interrupted at the inclined portion 141*b*. In the process of waste toner transportation, the movement restrictor 143 restricts the movement of the waste toner. Meanwhile, waste toner is sequentially transported from the upstream side in the waste toner transport direction X. The waste toner whose movement is restricted is thus pressed by the waste toner transported from the upstream side and is thus gradually compressed and compacted. Waste toner thus increases its bulk density.

When the waste toner is discharged from the waste toner transport unit 140 and collected in the waste toner container, the waste toner accumulates in the waste toner container without leaving a space. Thus, the amount of waste toner collected in the waste toner container increases compared to the case where waste toner is collected by an existing waste toner transport unit.

Sixth Embodiment

Figure 7:
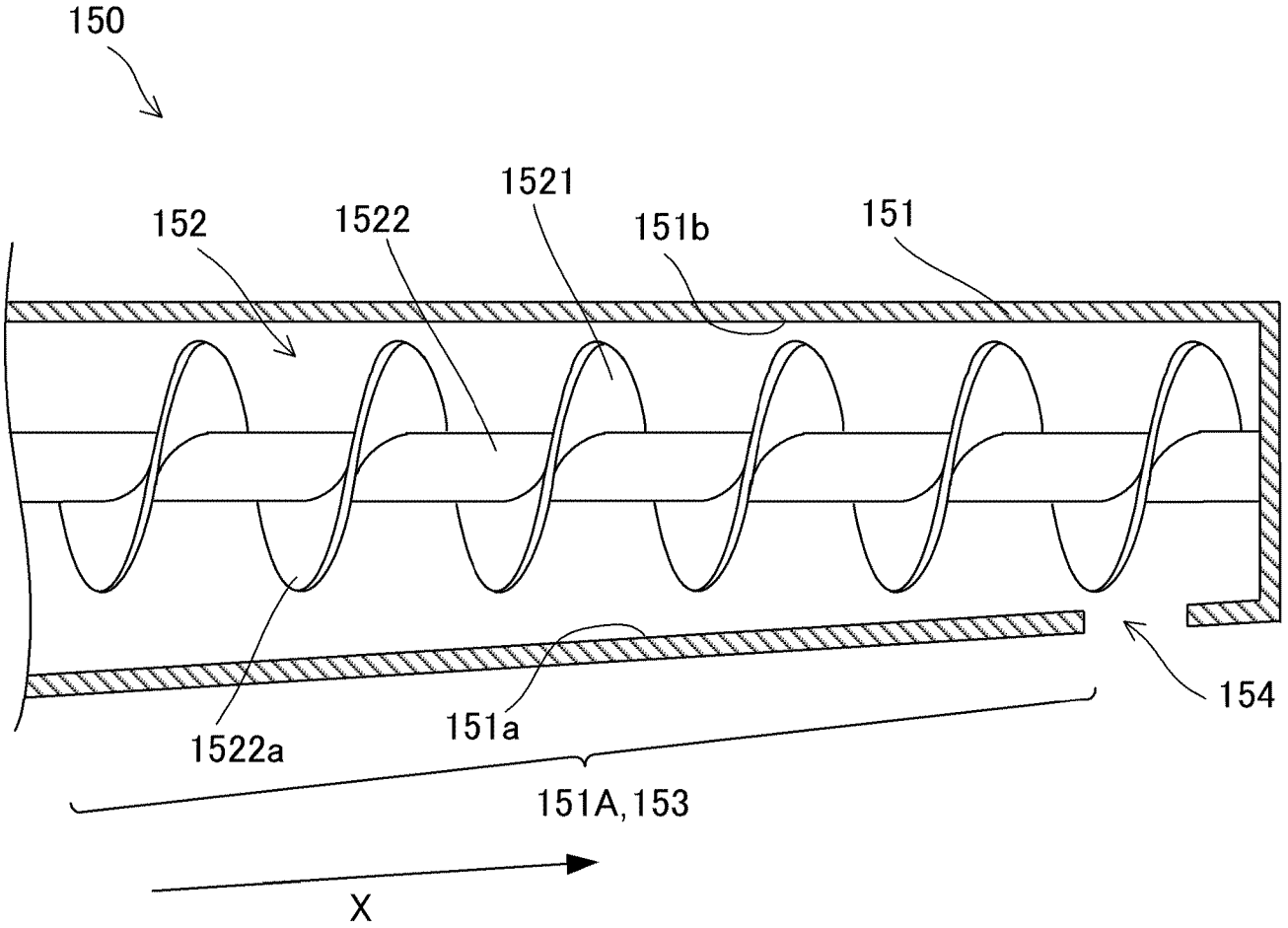
FIG. 7 is a schematic cutaway view of a related portion of a waste toner transport unit according to a sixth embodiment.

As illustrated in FIG. 7, a waste toner transport unit 150 according to a sixth embodiment of the disclosure includes a waste toner transport path 151, a transport screw 152, and a movement restrictor 153. Similarly to the waste toner transport path 101 of the waste toner transport unit 100, the waste toner transport path 151 is disposed so as to at least partially face the photoconductor drum and the cleaning blade (refer to FIGS. 1, 14A, and 14B). The transport screw 152 corresponds to a transport member according to an aspect of the disclosure. Similarly to the waste toner transport path 101 of the waste toner transport unit 100, the waste toner transport path 151 allows waste toner to be transported therethrough.

The waste toner transport path 151 has an inner bottom surface 151*a* having an outlet port 154, from which waste toner is discharged, at a downstream portion in the transport direction X (indicated with an arrow in FIG. 7). Waste toner is discharged from the outlet port 154 and collected in a waste toner container, not illustrated.

As illustrated in FIG. 7, the waste toner transport path 151 has an area 151A, in which an inner bottom surface 151*a* and an inner top surface 151*b* extend nonparallel with each other from the upstream side to the downstream side in the transport direction X. Specifically, in this embodiment, in the area 151A, the inner bottom surface 151*a* is inclined upward from the upstream side to the downstream side in the transport direction X, whereas the inner top surface 151*b* extends horizontally from the upstream side to the downstream side in the transport direction X. Here, the expression of "the inner top surface" means "an inner surface located on the upper side" in the vertical direction when the waste toner transport unit 150 is installed in the image forming apparatus 11 in a normal position. This similarly applies to the following description.

As illustrated in FIG. 7, similarly to the transport screw 102 of the waste toner transport unit 100, the transport screw 152 includes a rotation shaft 1521 and a helical blade member 1522, which has an edge portion 1522*a*. The transport screw 152 is disposed such that the rotation shaft 1521 extends horizontally. When the transport screw 152 rotates, waste toner moves in the transport direction X along the inner bottom surface 151*a* while being agitated by the blade member 1522 and is transported to the outlet port 154.

In this embodiment, the area 151A of the waste toner transport path 151 functions as the movement restrictor 153. Specifically, a space in the movement restrictor 153 through which waste toner passes tapers since the cross-sectional area perpendicular to the waste toner transport direction X decreases in the transport direction X. Thus, the amount of waste toner transported is limited and the movement restrictor 153 restricts the movement of the waste toner. Meanwhile, waste toner is sequentially transported from the upstream side in the waste toner transport direction X. Thus, the waste toner whose movement is restricted is pressed by the waste toner transported from the upstream side and is thus gradually compressed and compacted. The waste toner thus increases its bulk density.

When the waste toner is discharged from the waste toner transport unit 150 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

Seventh Embodiment

Figure 8:
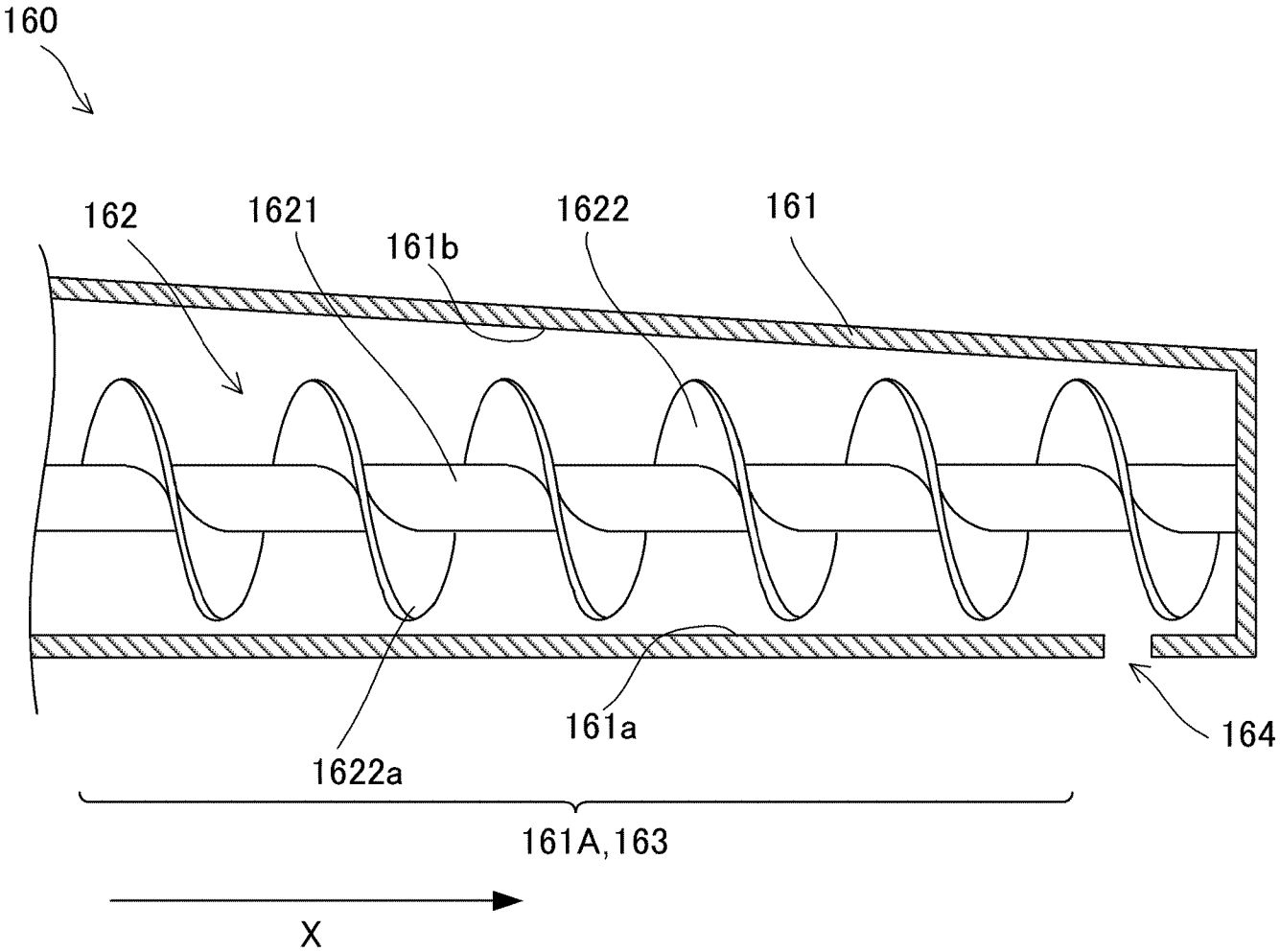
FIG. 8 is a schematic cutaway view of a related portion of a waste toner transport unit according to a seventh embodiment.

As illustrated in FIG. 8, a waste toner transport unit 160 according to a seventh embodiment of the disclosure includes a waste toner transport path 161, a transport screw 162, and a movement restrictor 163. Similarly to the waste toner transport path 101 of the waste toner transport unit 100, the waste toner transport path 161 is disposed so as to at least partially face the photoconductor drum and the cleaning blade (refer to FIGS. 1, 14A, and 14B). The transport screw 162 corresponds to a transport member according to an aspect of the disclosure. Similarly to the waste toner transport path 101 of the waste toner transport unit 100, the waste toner transport path 161 allows waste toner to be transported therethrough.

The waste toner transport path 161 has an inner bottom surface 161*a* having an outlet port 164, from which waste toner is discharged, at a downstream portion in the transport direction X (indicated with an arrow in FIG. 8). Waste toner is discharged from the outlet port 164 and collected in a waste toner container, not illustrated.

As illustrated in FIG. 8, the waste toner transport path 161 has an area 161A, in which an inner bottom surface 161*a* and an inner top surface 161*b* extend nonparallel with each other from the upstream side to the downstream side in the transport direction X. Specifically, in this embodiment, in the area 161A, the inner bottom surface 161*a* extends horizontally from the upstream side to the downstream side in the transport direction X, whereas the inner top surface 161*b* is inclined downward from the upstream side to the downstream side in the transport direction X.

As illustrated in FIG. 8, similarly to the transport screw 102 of the waste toner transport unit 100, the transport screw 162 includes a rotation shaft 1621 and a helical blade member 1622, which has an edge portion 1622*a*. The transport screw 162 is disposed such that the rotation shaft 1621 extends along the inner bottom surface 161*a*. When the transport screw 162 rotates, waste toner moves in the transport direction X while being agitated by the blade member 1622 and is transported to the outlet port 164.

In this embodiment, the area 161A of the waste toner transport path 161 functions as the movement restrictor 163. Specifically, a space in the movement restrictor 163 through which waste toner passes tapers since the cross-sectional area perpendicular to the waste toner transport direction X decreases in the transport direction X. Thus, the amount of waste toner transported is limited and the movement restrictor 163 restricts the movement of the waste toner. Meanwhile, waste toner is sequentially transported from the upstream side in the waste toner transport direction X. Thus, the waste toner whose movement is restricted is pressed by the waste toner transported from the upstream side and is thus gradually compressed and compacted. The waste toner thus increases its bulk density.

When the waste toner is discharged from the waste toner transport unit 160 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

Eighth Embodiment

Figure 9:
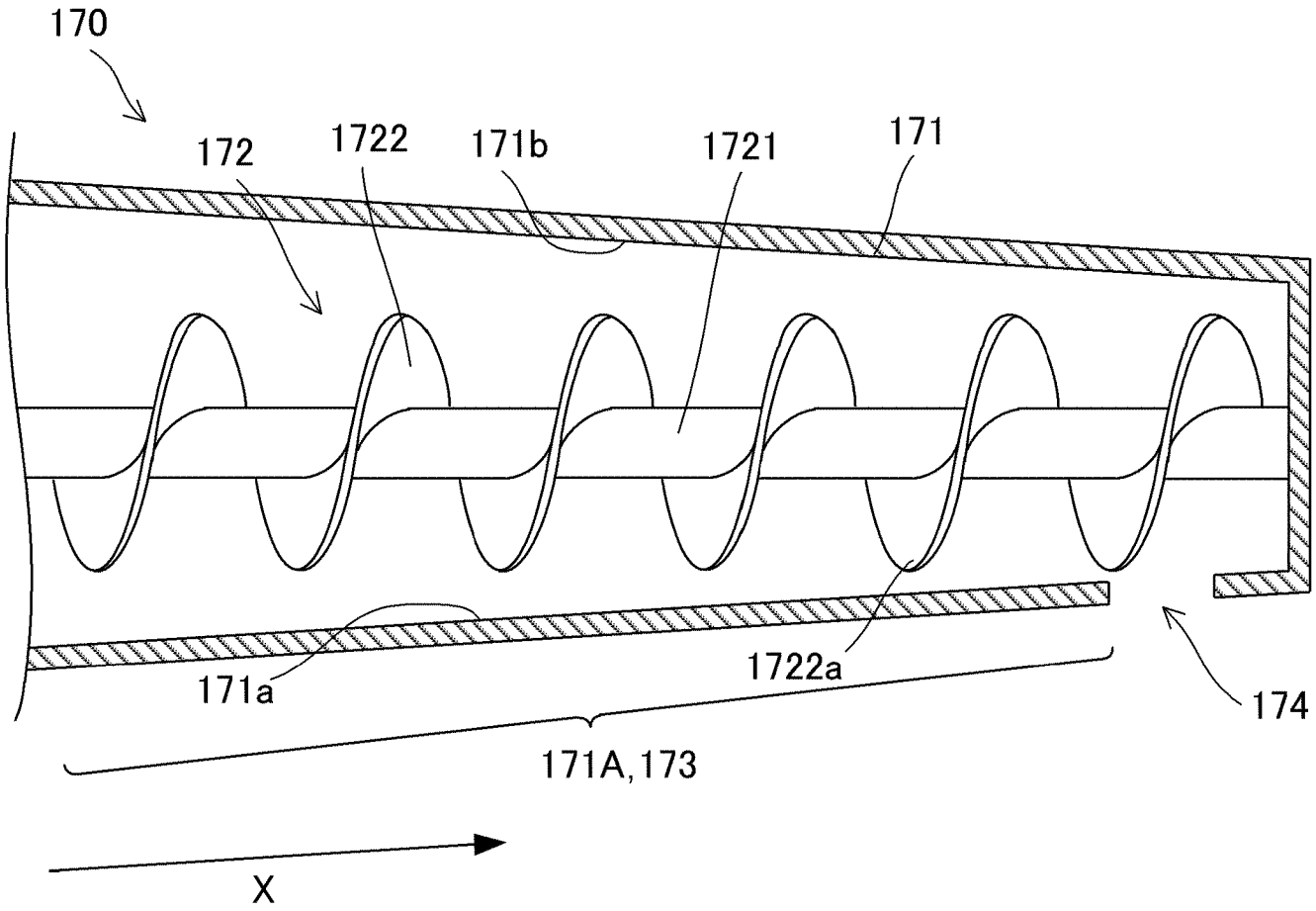
FIG. 9 is a schematic cutaway view of a related portion of a waste toner transport unit according to an eighth embodiment.

As illustrated in FIG. 9, a waste toner transport unit 170 according to an eighth embodiment of the disclosure includes a waste toner transport path 171, a transport screw 172, and a movement restrictor 173. Similarly to the waste toner transport path 101 of the waste toner transport unit 100, the waste toner transport path 171 is disposed so as to at least partially face the photoconductor drum and the cleaning blade (refer to FIGS. 1, 14A, and 14B). The transport screw 172 corresponds to a transport member according to an aspect of the disclosure. Similarly to the waste toner transport path 101 of the waste toner transport unit 100, the waste toner transport path 171 allows waste toner to be transported therethrough.

The waste toner transport path 171 has an inner bottom surface 171*a* having an outlet port 174, from which waste toner is discharged, at a downstream portion in the transport direction X (indicated with an arrow in FIG. 9). Waste toner is discharged from the outlet port 174 and collected in a waste toner container, not illustrated.

As illustrated in FIG. 9, the waste toner transport path 171 has an area 171A that narrows from the upstream side to the downstream side in the transport direction X. Specifically, in this embodiment, in the area 171A, the inner bottom surface 171*a* is inclined upward from the upstream side to the downstream side in the transport direction X, whereas an inner top surface 171*b* is inclined downward from the upstream side to the downstream side in the transport direction X.

As illustrated in FIG. 9, similarly to the transport screw 102 of the waste toner transport unit 100, the transport screw 172 includes a rotation shaft 1721 and a helical blade member 1722, which has an edge portion 1722*a*. The transport screw 172 is disposed such that the rotation shaft 1721 extends horizontally. When the transport screw 172 rotates, waste toner moves along the inner bottom surface 171*a* in the transport direction X while being agitated by the blade member 1722 and is transported to the outlet port 174.

In this embodiment, the narrowing area 171A of the waste toner transport path 171 functions as the movement restrictor 173. Specifically, a space in the movement restrictor 173 through which waste toner passes tapers since the cross-sectional area perpendicular to the waste toner transport direction X decreases in the transport direction X. Thus, the amount of waste toner transported is limited and the movement restrictor 173 restricts the movement of the waste toner. Meanwhile, waste toner is sequentially transported from the upstream side in the waste toner transport direction X. Thus, the waste toner whose movement is restricted is pressed by the waste toner transported from the upstream side and is thus gradually compressed and compacted. The waste toner thus increases its bulk density.

When the waste toner is discharged from the waste toner transport unit 170 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

In each of the waste toner transport units 150, 160, and 170 according to the sixth to eighth embodiments, the shapes and the sizes (including the helical groove pitch and width) of the rotation shaft and the blade member of the transport screw are uniform from the upstream side to the downstream side in the transport direction X. Instead, the transport screw of each of the waste toner transport units 150, 160, and 170 may be modified so that the shapes and the sizes of the rotation shaft and the blade member are changed in accordance with the cross-sectional area perpendicular to the waste toner transport direction X. For example, in the transport screw of the waste toner transport unit 170 according to the eighth embodiment, the edge portion of the blade member may be disposed so as to come into contact with or be adjacent to the inner top surface and the inner bottom surface of the waste toner transport path. Specifically, the size of the blade member of the transport screw is reduced as the space through which waste toner passes tapers.

Ninth Embodiment

Figure 10:
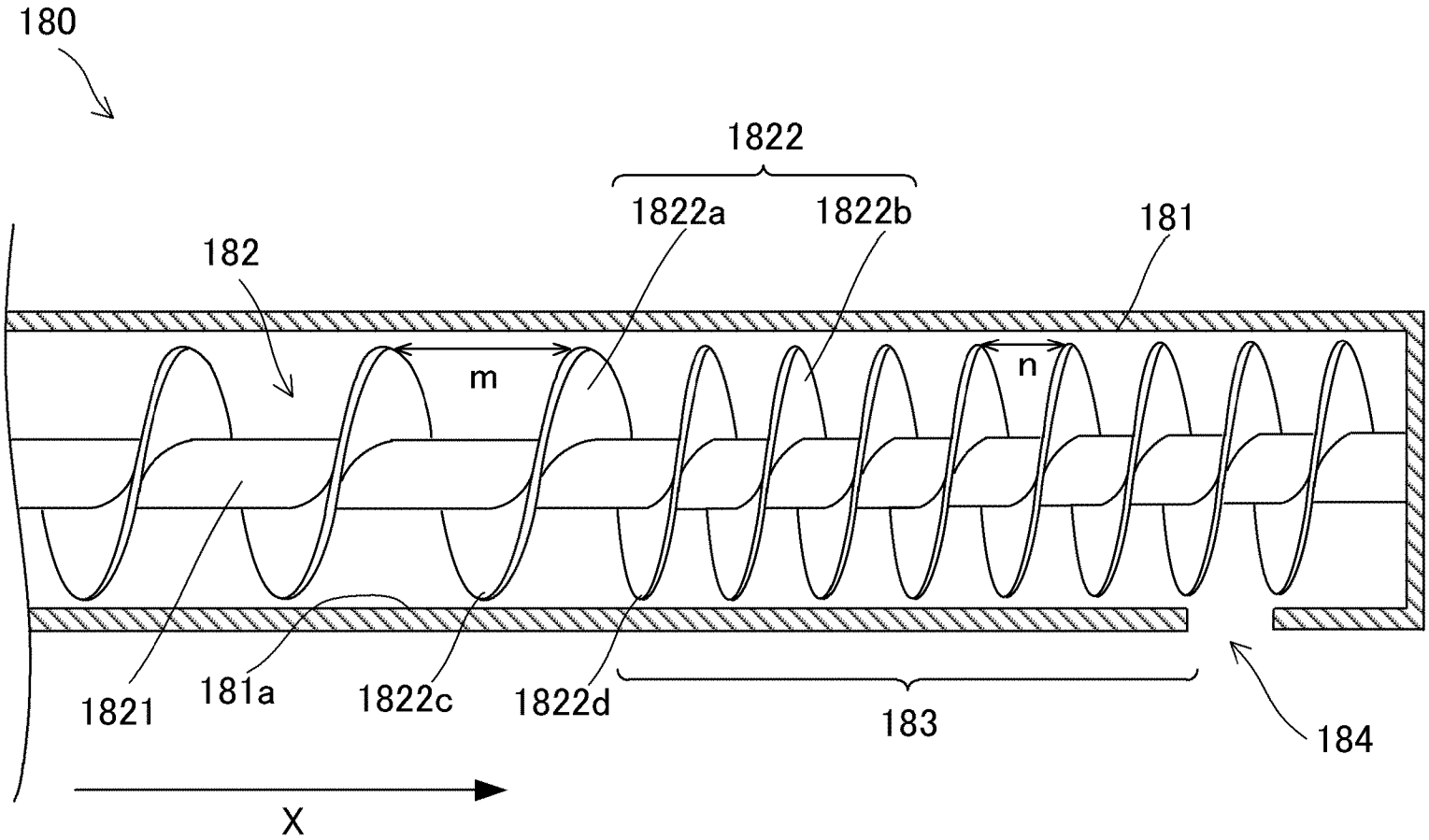
FIG. 10 is a schematic cutaway view of a related portion of a waste toner transport unit according to a ninth embodiment.

As illustrated in FIG. 10, a waste toner transport unit 180 according to a ninth embodiment of the disclosure includes a waste toner transport path 181, a transport screw 182, and a movement restrictor 183. Similarly to the waste toner transport path 101 of the waste toner transport unit 100, the waste toner transport path 181 is disposed so as to at least partially face the photoconductor drum and the cleaning blade (refer to FIGS. 1, 14A, and 14B). The transport screw 182 corresponds to a transport member according to an aspect of the disclosure. Similarly to the waste toner transport path 101 of the waste toner transport unit 100, the waste toner transport path 181 allows waste toner to be transported therethrough.

The waste toner transport path 181 has an inner bottom surface 181*a* having an outlet port 184, from which waste toner is discharged, at a downstream portion in the transport direction X (indicated with an arrow in FIG. 10). Waste toner is discharged from the outlet port 184 and collected in a waste toner container, not illustrated. The waste toner transport path 181 extends horizontally from the upstream side to the downstream side in the transport direction X.

The transport screw 182 transports waste toner along the waste toner transport path 181. As illustrated in FIG. 10, the transport screw 182 includes a rotation shaft 1821 and a helical blade member 1822 disposed on the circumferential surface of the rotation shaft 1821. The blade member 1822 includes two blade portions 1822*a* and 1822*b* having differently pitched helices. The transport screw 182 is disposed such that the blade portion 1822*a* is located on the upstream portion in the transport direction X and the blade portion 1822*b* is located on the downstream portion in the transport direction X. When the helix pitch of the blade portion 1822*a* is represented as m and the helix pitch of the blade portion 1822*b* is represented as n, n is smaller than m.

The transport screw 182 is disposed in the waste toner transport path 181 such that an edge portion 1822*c* of the blade portion 1822*a* and an edge portion 1822*d* of the blade portion 1822*b* disposed along the inner bottom surface 181*a* come into contact with or are adjacent to the inner bottom surface 181*a* of the waste toner transport path 181. When the transport screw 182 rotates, waste toner moves in the transport direction X while being agitated by the blade member 1822 (blade portions 1822*a* and 1822*b*) and is transported to the outlet port 184.

In this embodiment, in the waste toner transport path 181, the downstream portion of the transport screw 182 in which the blade portion 1822*b* is disposed functions as the movement restrictor 183. Specifically, since the blade portion 1822*b* of the transport screw 182 has a smaller pitch, waste toner passing by the movement restrictor 183 moves more slowly. In the process of waste toner transportation, the movement restrictor 183 thus restricts the movement of waste toner. Meanwhile, waste toner is sequentially transported from the upstream side in the transport direction X. The waste toner whose movement is restricted is thus pressed by the waste toner transported from the upstream side and is thus gradually compressed and compacted. Waste toner thus increases its bulk density.

When the waste toner is discharged from the waste toner transport unit 180 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

Tenth Embodiment

Figure 11:
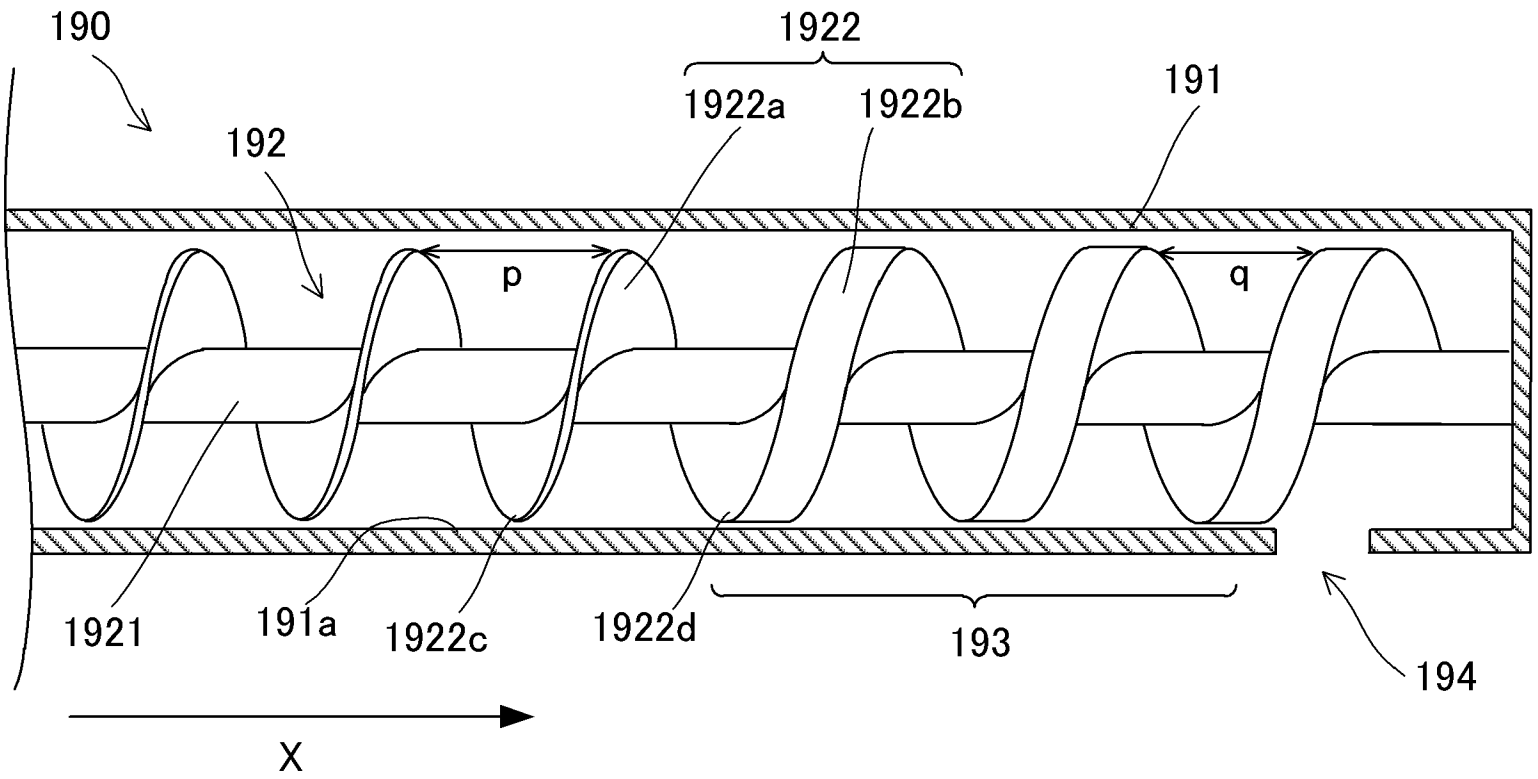
FIG. 11 is a schematic cutaway view of a related portion of a waste toner transport unit according to a tenth embodiment.

As illustrated in FIG. 11, a waste toner transport unit 190 according to a tenth embodiment of the disclosure includes a waste toner transport path 191, a transport screw 192, and a movement restrictor 193. Similarly to the waste toner transport path 101 of the waste toner transport unit 100, the waste toner transport path 191 is disposed so as to at least partially face the photoconductor drum and the cleaning blade (refer to FIGS. 1, 14A, and 14B). The transport screw 192 corresponds to a transport member according to an aspect of the disclosure. Similarly to the waste toner transport path 101 of the waste toner transport unit 100, the waste toner transport path 191 allows waste toner to be transported therethrough.

The waste toner transport path 191 has an inner bottom surface 191*a* having an outlet port 194, from which waste toner is discharged, at a downstream portion in the transport direction X (indicated with an arrow in FIG. 11). Waste toner is discharged from the outlet port 194 and collected in a waste toner container, not illustrated. The waste toner transport path 191 extends horizontally from the upstream side to the downstream side in the transport direction X.

The transport screw 192 transports waste toner along the waste toner transport path 191. As illustrated in FIG. 11, the transport screw 192 includes a rotation shaft 1921 and a helical blade member 1922 disposed on the circumferential surface of the rotation shaft 1921. The blade member 1922 includes two blade portions 1922*a* and 1922*b* whose helix grooves have different widths. The transport screw 192 is disposed such that the blade portion 1922*a* is disposed on the upstream portion in the transport direction X and the blade portion 1922*b* is disposed on the downstream portion in the transport direction X. When the helix groove width of the blade portion 1922*a* is represented as p and the helix groove width of the blade portion 1922*b* is represented as q, q is smaller than p.

The transport screw 192 is disposed in the waste toner transport path 191 such that an edge portion 1922*c* of the blade portion 1922*a* and an edge portion 1922*d* of the blade portion 1922*b* disposed along the inner bottom surface 191*a* come into contact with or are adjacent to the inner bottom surface 191*a* of the waste toner transport path 191. When the transport screw 192 rotates, waste toner moves in the transport direction X while being agitated by the blade member 1922 (blade portions 1922*a* and 1922*b*) and is transported to the outlet port 194.

In this embodiment, in the waste toner transport path 191, the downstream portion of the transport screw 192 in which the blade portion 1922*b* is disposed functions as the movement restrictor 193. Specifically, a space in the downstream portion of the transport screw 192 through which waste toner passes tapers, so that the amount of waste toner transported is limited. The movement restrictor 193 thus restricts the movement of waste toner. Meanwhile, waste toner is sequentially transported from the upstream side in the waste toner transport direction X. The waste toner whose movement is restricted is thus pressed by the waste toner transported from the upstream side and is thus gradually compressed and compacted. Waste toner thus increases its bulk density.

When the waste toner is discharged from the waste toner transport unit 190 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

Eleventh Embodiment

Figure 12:
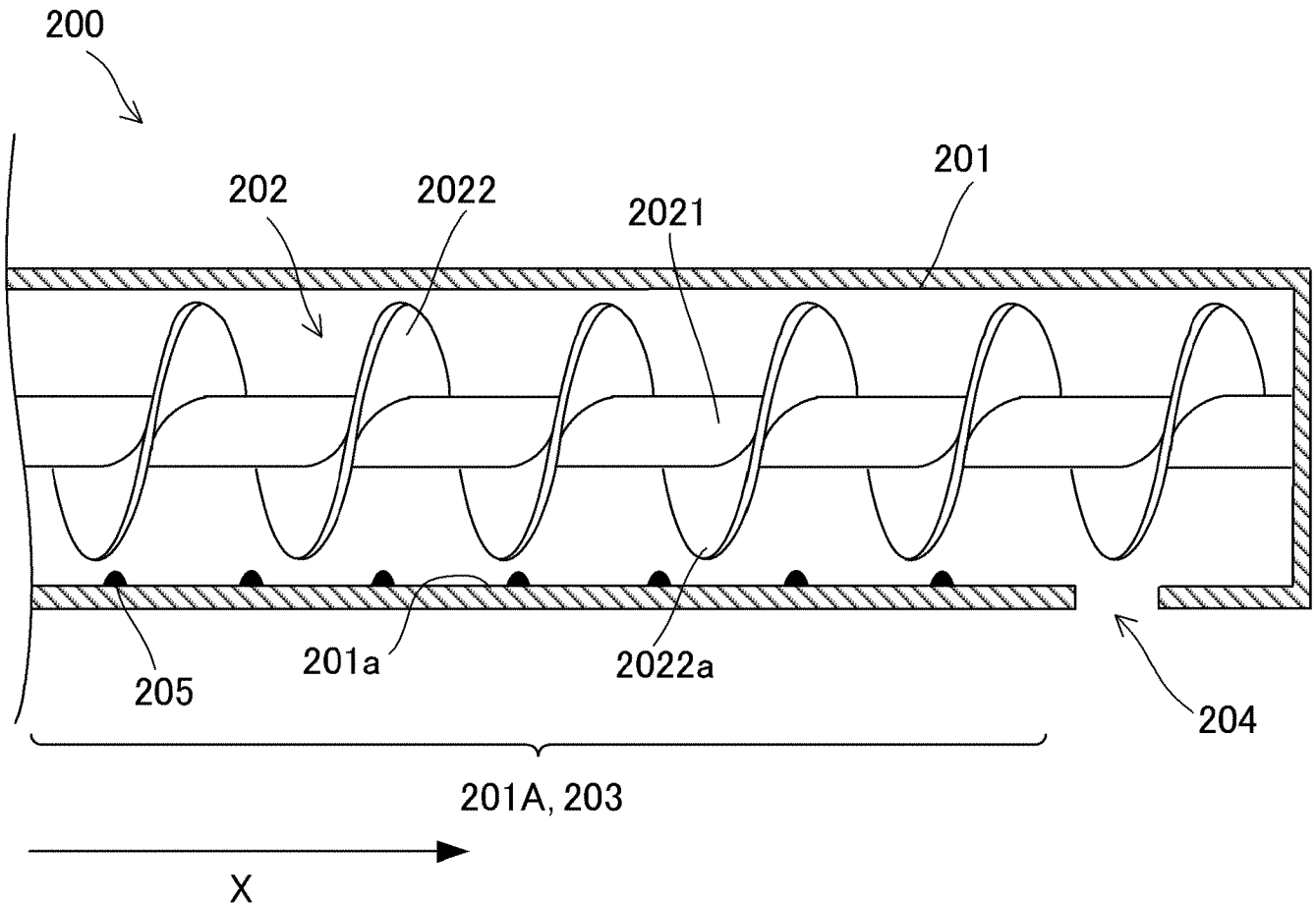
FIG. 12 is a schematic cutaway view of a related portion of a waste toner transport unit according to an eleventh embodiment.

As illustrated in FIG. 12, a waste toner transport unit 200 according to an eleventh embodiment of the disclosure includes a waste toner transport path 201, a transport screw 202, and a movement restrictor 203. Similarly to the waste toner transport path 101 of the waste toner transport unit 100, the waste toner transport path 201 is disposed so as to at least partially face the photoconductor drum and the cleaning blade (refer to FIGS. 1, 14A, and 14B). The transport screw 202 corresponds to a transport member according to an aspect of the disclosure. Similarly to the waste toner transport path 101 of the waste toner transport unit 100, the waste toner transport path 201 allows waste toner to be transported therethrough.

The waste toner transport path 201 has an inner bottom surface 201*a* having an outlet port 204, from which waste toner is discharged, at a downstream portion in the transport direction X (indicated with an arrow in FIG. 12). Waste toner is discharged from the outlet port 204 and collected in a waste toner container, not illustrated. The waste toner transport path 201 extends horizontally from the upstream side to the downstream side in the transport direction X. The waste toner transport path 201 includes multiple protrusions 205 on the inner bottom surface 201*a*.

The transport screw 202 transports waste toner along the waste toner transport path 201. As illustrated in FIG. 12, similarly to the transport screw 102 of the waste toner transport unit 100, the transport screw 202 includes a rotation shaft 2021 and a helical blade member 2022, which has an edge portion 2022*a*. The transport screw 202 is disposed such that the rotation shaft 2021 extends along the inner bottom surface 201*a*. When the transport screw 202 rotates, waste toner moves in the transport direction X while being agitated by the blade member 2022 and is transported to the outlet port 204.

In this embodiment, an area 201A of the inner bottom surface 201*a* of the waste toner transport path 201 in which the multiple protrusions 205 are disposed functions as the movement restrictor 203. Specifically, a portion of waste toner passing by the movement restrictor 203 is interrupted by the protrusions 205. In the process of waste toner transportation, the movement restrictor 203 restricts the movement of the waste toner. Meanwhile, waste toner is sequentially transported from the upstream side in the waste toner transport direction X. The waste toner whose movement is restricted is thus pressed by the waste toner transported from the upstream side and is thus gradually compressed and compacted. Waste toner thus increases its bulk density.

When the waste toner is discharged from the waste toner transport unit 200 and collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

Twelfth Embodiment

Figure 13:
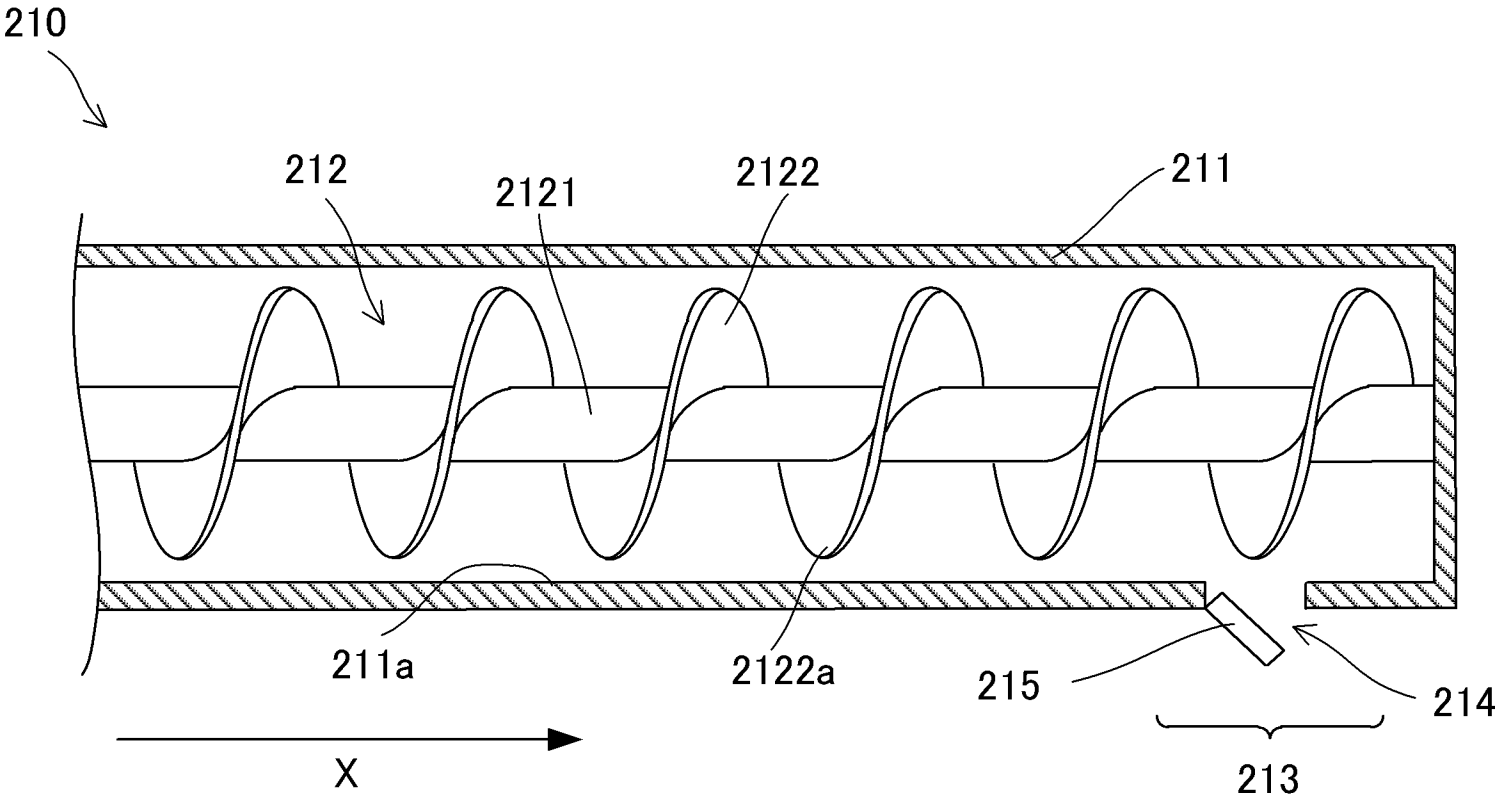
FIG. 13 is a schematic cutaway view of a related portion of a waste toner transport unit according to a twelfth embodiment.

As illustrated in FIG. 13, a waste toner transport unit 210 according to a twelfth embodiment of the disclosure includes a waste toner transport path 211, a transport screw 212, and a movement restrictor 213. Similarly to the waste toner transport path 101 of the waste toner transport unit 100, the waste toner transport path 211 is disposed so as to at least partially face the photoconductor drum and the cleaning blade (refer to FIGS. 1, 14A, and 14B). The transport screw 212 corresponds to a transport member according to an aspect of the disclosure. Similarly to the waste toner transport path 101 of the waste toner transport unit 100, the waste toner transport path 211 allows waste toner to be transported therethrough.

The waste toner transport path 211 has an inner bottom surface 211*a* having an outlet port 214, from which waste toner is discharged, at a downstream portion in the transport direction X (indicated with an arrow in FIG. 13). Waste toner is discharged from the outlet port 214 and collected in a waste toner container, not illustrated. The waste toner transport path 211 extends horizontally from the upstream side to the downstream side in the transport direction X.

The waste toner transport path 211 also includes a door 215 that can render the outlet port 214 open and closed. The door 215 renders the outlet port 214 open when receiving a predetermined weight.

The transport screw 212 transports waste toner along the waste toner transport path 211. As illustrated in FIG. 13, similarly to the transport screw 102 of the waste toner transport unit 100, the transport screw 212 includes a rotation shaft 2121 and a helical blade member 2122, which has an edge portion 2122*a*. When the transport screw 212 rotates, waste toner moves in the transport direction X while being agitated by the blade member 2122 and is transported to a portion above the door 215. The door 215 opens when the door 215 receives a predetermined weight. Thus, the waste toner is collected in a waste toner container, not illustrated, through the outlet port 214.

In this embodiment, the door 215 disposed at the outlet port 214 functions as the movement restrictor 213. Specifically, in the movement restrictor 213, the waste toner accumulates on the door 215 until reaching a predetermined weight. Meanwhile, waste toner is sequentially transported from the upstream side in the transport direction X. The waste toner accumulating on the door 215 is pressed by the waste toner transported from the upstream side and is thus gradually compressed and compacted. Waste toner thus increases its bulk density.

When the door 215 opens while the waste toner is in this state, the waste toner having higher bulk density is discharged from the waste toner transport unit 210. When collected in the waste toner container, the waste toner accumulates in the waste toner container without leaving a space. Thus, the amount of waste toner collected in the waste toner container increases compared to the case where waste toner is collected by an existing waste toner transport unit (refer to FIGS. 14A and 14B).

OTHER EMBODIMENTS

Thus far, the waste toner transport units 100 to 210 according to the first to twelfth embodiments have been described. A waste toner transport unit of an aspect of the disclosure may be formed by combining any of these.

For example, a movement restrictor may have a configuration in which part of the inner bottom surface of the waste toner transport path is inclined (as in the case of the movement restrictor 103 according to the first embodiment) and the helical blade member of the transport screw is pitched differently between the upstream portion and the downstream portion (as in the case of the movement restrictor 183 according to the eleventh embodiment).

A waste toner transport unit including such a movement restrictor further restricts the movement of waste toner in the waste toner transport path. Thus, in the process of transportation, waste toner is further compacted and increases its bulk density. The amount of waste toner collected in the waste toner container thus increases further.

A waste toner transport unit according to an aspect of the disclosure does not require a user to shake the waste toner container to compact the waste toner and thus facilitates user-friendliness. In addition, the amount of waste toner collected in the waste toner container increases, so that the waste toner container can have a smaller size.

A waste toner transport unit according to an aspect of the disclosure is also applicable to a cleaner used to collect toner left on the surface of the intermediate transfer belt 21.

All the embodiments described above are exemplary throughout and should not be construed as being limitative. The scope of the disclosure is defined by the scope of claims, not by the above-described embodiments. The scope of the disclosure includes the scope of claims, equivalent thereof, and all the modifications within the scope.

The present disclosure contains subject matter related to that disclosed in Japanese Priority Patent Application JP 2016-122431 filed in the Japan Patent Office on Jun. 21, 2016, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A waste toner transport unit comprising:

a waste toner transport path through which waste toner removed from a circumferential surface of an image carrier is transported;

a transport member that transports the waste toner along the waste toner transport path; and a movement restrictor that restricts movement of the waste toner in a process of transportation of the waste toner, wherein the waste toner transport path has an inner bottom surface, and includes a first area in which the inner bottom surface is parallel to a transport direction of the waste toner and a second area in which the inner bottom surface is not parallel to the transport direction of the waste toner, the second area is continuous with the first area at a downstream side, and the first area and the second area constitute at least a part of the movement restrictor.

2. The waste toner transport unit according to claim 1, wherein the transport member is a transport screw including a rotation shaft extending along the inclined inner bottom surface.

3. The waste toner transport unit according to claim 1, wherein the waste toner transport path includes an area whose cross-sectional area taken perpendicular to a transport direction of the waste toner tapers and the area constitutes at least a part of the movement restrictor.

4. An image forming apparatus comprising:

an image carrier;

a cleaning unit that removes toner left on a circumferential surface of the image carrier as waste toner; and the waste toner transport unit according to claim 1 that transports the waste toner removed by the cleaning unit.

5. A waste toner transport unit comprising:

a waste toner transport path through which waste toner removed from a circumferential surface of an image carrier is transported;

a transport member that transports the waste toner along the waste toner transport path; and a movement restrictor that restricts movement of the waste toner in a process of transportation of the waste toner, wherein the transport member is a transport screw including an upstream portion and a downstream portion in a transport direction of the waste toner, the downstream portion has a helical groove having a smaller width than a helical groove of the upstream portion, and the downstream portion constitutes at least a part of the movement restrictor.

6. A waste toner transport unit comprising:

a waste toner transport path through which waste toner removed from a circumferential surface of an image carrier is transported;

a transport member that transports the waste toner along the waste toner transport path; and a movement restrictor that restricts movement of the waste toner in a process of transportation of the waste toner, wherein the waste toner transport path includes a plurality of protrusions on an inner bottom surface that is not in contact with the transport member, and the protrusions are respectively substantially semispherical shape and constitutes at least a part of the movement restrictor.

7. A waste toner transport unit comprising:

a waste toner transport path through which waste toner removed from a circumferential surface of an image carrier is transported;

a transport member that transports the waste toner along the waste toner transport path; and a movement restrictor that restricts movement of the waste toner in a process of transportation of the waste toner, wherein an inner surface of the waste toner transport path includes a first area which is parallel to a transport direction of the waste toner and a second area which is not parallel to the transport direction of the waste toner, the second area is surrounded by the first area, and the first area and the second area constitute at least a part of the movement restrictor.

* * * * *